US005826306A

United States Patent [19]

Faubert et al.

[11] Patent Number: 5,826,306

[45] Date of Patent: Oct. 27, 1998

[54] SLIDING DOOR CENTER ADJUSTABLE HINGE

[75] Inventors: Robert J. Faubert, Rochester Hills; Richard C. Kapes, Shelby Township, both of Mich.

[73] Assignee: Chrysler Corporation, Auburn Hills, Mich.

[21] Appl. No.: 958,835

[22] Filed: Oct. 28, 1997

[51] Int. Cl.[6] ..... E05D 7/04

[52] U.S. Cl. ..... 16/244; 16/245; 16/262; 16/264; 16/285

[58] Field of Search ..... 16/244, 243, 273, 16/386, 245, 304, 307, 285, 295, 261, 262, 264, 265

[56] References Cited

U.S. PATENT DOCUMENTS

| | | | |
|---|---|---|---|
| 926,520 | 6/1909 | Thornton et al. | 16/285 |
| 1,336,780 | 4/1920 | Hickey | 16/244 |
| 1,341,690 | 6/1920 | Werner | 16/244 |
| 1,772,194 | 8/1930 | Schoemer | 16/244 |
| 1,803,438 | 5/1931 | Rocheron | 16/285 |
| 2,302,484 | 11/1942 | Werner | 16/244 |
| 2,779,966 | 2/1957 | Torchia | 16/244 |
| 2,885,722 | 5/1959 | Halliday | 16/243 |
| 4,353,146 | 10/1982 | Brockhaus | 16/273 |
| 4,979,263 | 12/1990 | Tolle | 16/262 |

*Primary Examiner*—Chuck Y. Mah
*Attorney, Agent, or Firm*—Thomas G. Pasternak

[57] ABSTRACT

A sliding door center adjustable hinge includes a first hinge member having a pair of spaced walls with aligned hinge pin receiving apertures and a second hinge member including a bracket received between the spaced walls with predetermined clearance for vertical motion therebetween. The bracket includes hinge pin receiving apertures aligned with the apertures of said spaced walls. A hinge pin is received in the apertures and includes a threaded shank, a shoulder and a head engageable for rotation of the pin. An internally threaded element is fixed to one of the first and second hinge members and engaged by the threaded shank of the hinge pin, and an axial abutment on the other of the hinge members is engaged by the shoulder of the hinge pin so as to movably support the one of the hinge members on another of the hinge members, whereby rotation of the hinge pin by engagement of the head axially adjusts the position of the hinge pin in the threaded element and thereby moves the movably supported hinge member vertically relative to the supporting hinge member.

9 Claims, 1 Drawing Sheet

SLIDING DOOR CENTER ADJUSTABLE HINGE

CROSS REFERENCE TO RELATED APPLICATIONS

This is a conventional application based on a provisional application filed Jan. 29, 1997 and assigned U.S. Ser. No. 60/036,173.

FIELD OF THE INVENTION

This invention relates to a vehicle sliding door adjustable hinge, and more particularly to an adjustable hinge that allows for vertical, up and down, adjustment of the sliding door through rotation of the hinge pin which causes displacement of the hinge portions along the axis of the hinge pin.

BACKGROUND OF THE INVENTION

It is known in the art relating to vehicle sliding doors commonly found on van type vehicles to utilize upper, lower and center hinges to support the door on the vehicle body and allow the door to be moved horizontally relative to the body to open and close the door. Typically, the center hinge includes a mounting plate having generally square mounting apertures through which mounting bolts are received and fastened into threaded apertures in the door. The center hinge also includes a roller assembly, hinged about a hinge pin to the mounting plate, for following a track along the vehicle body.

During the assembly process, the sliding door is adjusted relative to the center hinge by adjusting the mounting bolts passing through the mounting apertures. The square configuration of the mounting apertures allows both the fore and aft and the up and down relative positioning of the sliding door relative to the hinge to be set through the tightening and loosening of the mounting bolts. At the same time however, it is impossible to separate the fore and aft adjustment from the up and down adjustment. Therefore, the adjustment of either parameter, fore and aft or up and down, affects the other resulting in the loss of fore and aft alignment during up and down alignment and the loss of up and down alignment during fore and aft alignment.

SUMMARY OF THE INVENTION

The present invention provides a sliding door center adjustable hinge that separates fore and aft adjustment of a vehicle sliding door from the up and down adjustment of the sliding door improving the assembly process and avoiding the loss of adjustment of one parameter when the adjustment of the other is undertaken.

In carrying out the above object and other objects of the invention, the sliding door center adjustable hinge includes a first hinge member for mounting on the door defined by a mounting plate including a plurality of horizontally elongate apertures. The first hinge member also includes upper and lower hinge pin receiving spaced walls connected with and extending generally perpendicularly outward from opposite edges of the mounting plate. The spaced walls include aligned hinge pin receiving apertures extending therethrough.

A second hinge member is defined by a bracket supportable by a body-mounted track and including upper and lower spaced hinge pin receiving apertures, spaced to fit loosely, with a predetermined clearance, between the spaced walls of the first hinge member. A hinge pin, which includes a shoulder near the head end and is threaded at the other end, is inserted through the hinge pin receiving apertures of the adjustable hinge.

A nut is fastened on the lower hinge pin receiving wall in axial alignment with the axis of the hinge pin for receiving the threaded portion of the hinge pin. The shoulder of the hinge pin is received through the hinge pin receiving aperture in the upper hinge pin receiving wall and abuts the bracket around the periphery of its upper hinge pin receiving aperture, thereby supporting and positioning the first hinge member vertically with respect to the bracket.

Up and down adjustment of the door is made by rotating the hinge pin. This causes the threaded portion to turn in the fixed nut, moving the shoulder of the hinge pin axially relative to the first hinge member and thereby moving the first hinge member relative to the second hinge member. The fore and aft adjustment of the door is made by adjusting the mounting plate of the first hinge member relative to the door along the horizontally elongate slots and securing fasteners through the apertures into the door. The horizontally elongate slots allow the fore and aft adjustment to be made without loosing vertical, up and down adjustment.

These and other features and advantages of the invention will be more fully understood from the following detailed description of the invention taken together with the accompanying drawings.

DETAILED DESCRIPTION OF THE INVENTION

Figure 2:
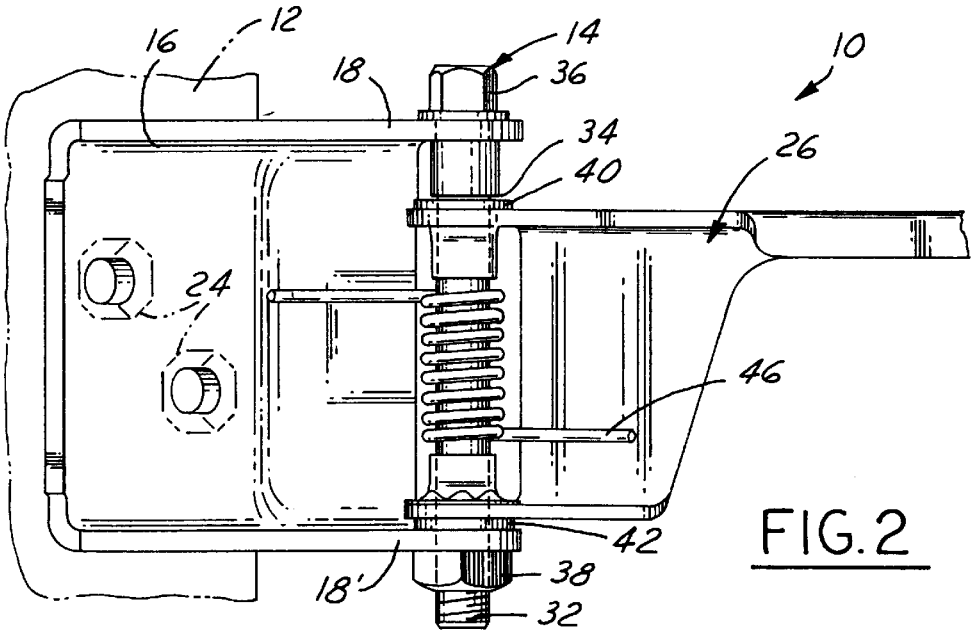
FIG. 2 is an assembled view of the hinge of FIG. 1 illustrated mounted to a vehicle sliding door.

Referring now to the drawings in detail, numeral 10 generally indicates an adjustable hinge for use as the center hinge on a van type vehicle sliding door 12, shown in phantom section in FIG. 2. As is more fully hereinafter described, the adjustable hinge 10 provides for vertical, up and down, adjustment of the door 12 relative to the vehicle body, not shown, through rotation of a hinge pin 14 and independent fore and aft adjustment of the door relative to the body.

Figure 1:
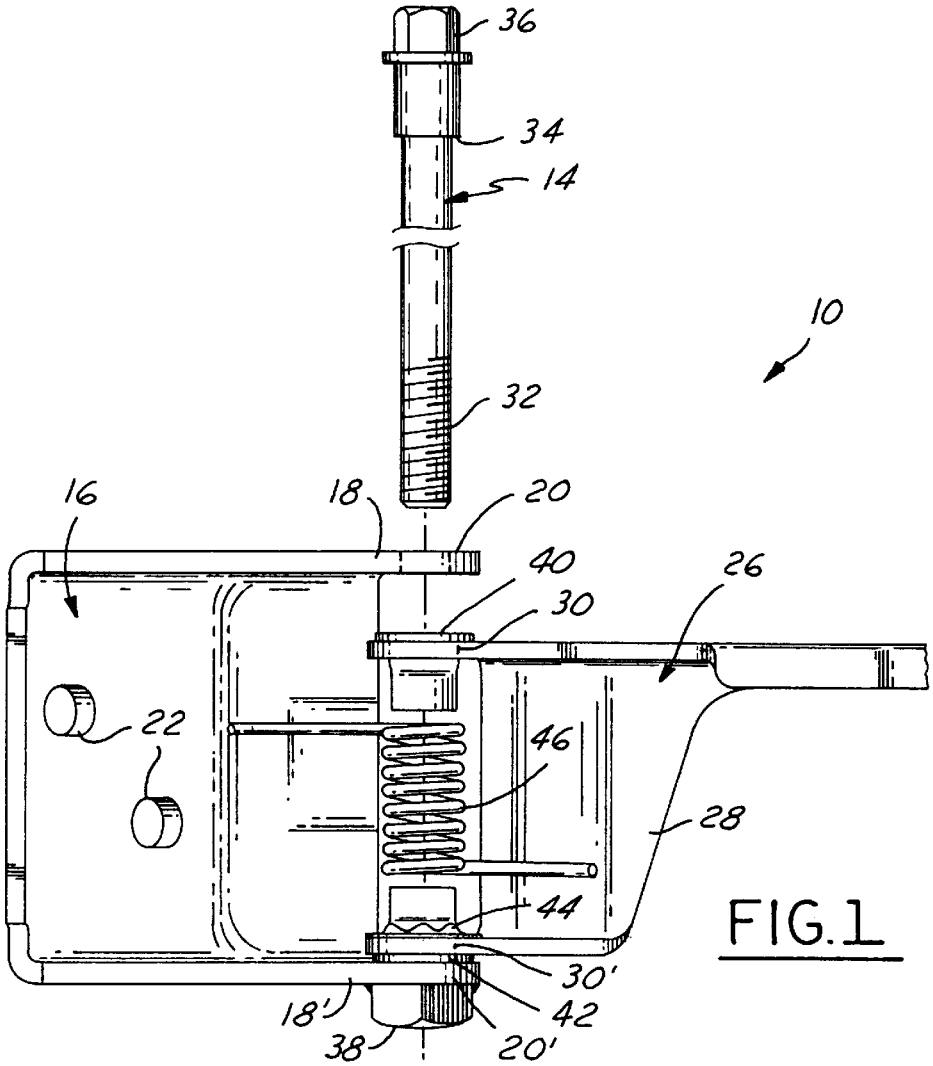
FIG. 1 is an exploded elevational view of a sliding door center adjustable hinge constructed in accordance with the present invention.

As illustrated in FIGS. 1 and 2, the adjustable hinge 10 includes a first hinge member 16 having a pair of spaced walls 18,18' with aligned hinge pin receiving apertures 20,20'.

The first hinge member 16 includes a plurality of horizontally elongate apertures or slots 22 for receiving bolts 24 which fasten to threaded apertures in the door as is known to attach the first hinge member to the door 12 and allow for fore and aft adjustment of the door as hereinafter described.

A second hinge member 26 includes a bracket 28 received between the spaced walls 18,18' with predetermined clearance for vertical motion therebetween. The bracket 28 includes hinge pin receiving apertures 30,30' aligned with the apertures 20,20' of the spaced walls 18,18'. Bracket 28 includes a roller assembly, not shown, spaced from the receiving apertures 30,30' and is thereby supported by a vehicle body mounted track as is known. Bracket 28 allows the door 12 to be moved horizontally relative to the vehicle body for opening and closing an opening therein.

The hinge pin 14 includes a threaded shank 32, a shoulder 34 and a head 36 engageable for rotation of the pin. The hinge pin 14 is received in the apertures 20,20' and 30,30' and the threaded shank 32 is received in a threaded element 38, herein a nut, fixed to the first hinge member 16 in axial alignment with the apertures. The shoulder 34 of the hinge pin 14 engages an axial abutment formed by an outer face of the bracket 28 surrounding the aperture 30. Through engagement of the pin 14 with the nut 38 the shoulder 34 movably supports the first hinge member 16 on the second hinge member 26 whereby rotation of the hinge pin by engagement of the head 36 axially adjusts the position of the hinge pin in the threaded element 38 and thereby adjusts the movably supported first hinge member 16 vertically relative to the second hinge member 26.

In the embodiment illustrated, the adjustable hinge includes upper and lower bushings 40,42 received in the bracket apertures 30,30'. Bushing 40 acts as the abutment engaged by the shoulder 34 of the hinge pin 14 in this embodiment. Additionally, it has been found preferable to utilize a retainer 44 to keep the lower bushing 42 in the aperture 30' in the bracket 28. The hinge 10 is also illustrated with a spring 46 which biases the first and second members 14,26 in an opening direction.

The fore and aft adjustment of the door 12 is made by adjusting the first hinge member 16 relative to the door 12 along the horizontally elongate slots 22 and securing bolts 24 through the slots into the door. Preferably, the horizontally elongate slots 22 are vertically and longitudinally offset in the first hinge member 16. The horizontally elongate slots 22 allow the fore and aft adjustment to be made without losing vertical, up and down adjustment as with conventional hinges.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An adjustable hinge comprising:

a first hinge member having a pair of spaced walls with aligned hinge pin receiving apertures, a second hinge member including a bracket received between the spaced walls with predetermined clearance for vertical motion therebetween, said bracket including hinge pin receiving apertures aligned with the apertures of said spaced walls, and a hinge pin received in said apertures and including a threaded shank, a shoulder and a head engageable for rotation of the pin, an internally threaded element fixed to one of said first and second hinge members and engaged by said threaded shank of the hinge pin, and an axial abutment on the other of said hinge members and engaged by the shoulder of the hinge pin so as to movably support one of said hinge members on another of the hinge members, whereby rotation of the hinge pin by engagement of the head axially adjusts the position of the hinge pin in the threaded element and thereby moves the movably supported hinge member vertically relative to the supporting hinge member.

2. The adjustable hinge of claim 1 wherein said internally threaded element is a nut in axial alignment with said hinge pin receiving apertures.

3. The adjustable hinge of claim 1 further including a bushing received in one of said hinge pin receiving apertures.

4. The adjustable hinge of claim 3 wherein the bushing forms said axial abutment engaged by said shoulder of the hinge pin.

5. The adjustable hinge of claim 3 further including a retainer for retaining said bushing in said receiving apertures.

6. The adjustable hinge of claim 1 further including a spring biasing said first and second hinge members in an opening direction.

7. The adjustable hinge of claim 1 wherein said first hinge member includes horizontally elongate slots for mounting said first hinge member.

8. The adjustable hinge of claim 7 wherein said horizontally elongate slots are longitudinally and vertically offset.

9. A vehicle sliding door center adjustable hinge comprising:

a first hinge member mountable on the door and including a mounting plate having a plurality of horizontally elongate apertures, upper and lower hinge pin receiving spaced walls connected with and extending generally perpendicularly outward from opposite edges of said mounting plate, said spaced walls including aligned hinge pin receiving apertures extending therethrough, and a nut fastened on said lower hinge pin receiving wall in axial alignment with said hinge pin receiving apertures, and a second hinge member including a bracket supportable by a body-mounted track, said bracket being sized to fit loosely between said spaced walls of the first hinge member with a predetermined clearance for vertical motion therebetween, said bracket including upper and lower spaced hinge pin receiving apertures aligned in assembly with the apertures of said spaced walls, a hinge pin having a head end and an opposite threaded end inserted through said hinge pin receiving apertures and engaging said nut, and said hinge pin having a shoulder spaced from the head end received through the hinge pin receiving aperture in said upper hinge pin receiving wall, the shoulder engaging an abutment adjacent the periphery of said upper hinge pin receiving aperture of said bracket thereby supporting and positioning said first hinge member vertically with respect to said bracket, whereby rotation of said hinge pin causes said threaded portion to turn in said fixed nut, moving said shoulder of said hinge pin axially relative to said first hinge member and thereby moving said first hinge member relative to said second hinge member to cause vertical adjustment of the door relative to the vehicle body.

* * * * *